US005357920A

United States Patent [19]

Kemnitz et al.

[11] Patent Number: 5,357,920

[45] Date of Patent: Oct. 25, 1994

[54] COOLED MULTI-COMPONENT PISTON FOR INTERNAL COMBUSTION ENGINES

[75] Inventors: Peter Kemnitz, Kernen; Gotthard Stuska, Fellbach; Wolfgang Bierkant, Benningen, all of Fed. Rep. of Germany

[73] Assignee: Mahle GmbH, Stuttgart, Fed. Rep. of Germany

[21] Appl. No.: 75,548

[22] PCT Filed: Nov. 23, 1991

[86] PCT No.: PCT/DE91/00928

§ 371 Date: Jun. 10, 1993

§ 102(e) Date: Jun. 10, 1993

[87] PCT Pub. No.: WO92/10659

PCT Pub. Date: Jun. 25, 1992

[30] Foreign Application Priority Data

Dec. 13, 1990 [DE] Fed. Rep. of Germany ..... 4039752
Dec. 13, 1990 [DE] Fed. Rep. of Germany ..... 4039754

[51] Int. Cl.[5] ..... F02F 3/00

[52] U.S. Cl. ..... 123/193.6; 92/186

[58] Field of Search ..... 123/41.35, 193.6; 92/159, 186

[56] References Cited

U.S. PATENT DOCUMENTS

| | | | |
|---|---|---|---|
| 1,900,521 | 3/1933 | Price | 92/186 |
| 4,377,967 | 3/1983 | Pelizzoni | 92/186 |
| 4,986,167 | 1/1991 | Stratton et al. | 123/193.6 |
| 5,052,280 | 10/1991 | Kopf et al. | 92/186 |
| 5,144,923 | 9/1992 | Leites et al. | 92/186 |

FOREIGN PATENT DOCUMENTS

252638A1 12/1987 Fed. Rep. of Germany .

*Primary Examiner*—Noah P. Kamen
*Attorney, Agent, or Firm*—Collard & Roe

[57] ABSTRACT

A cooled multi-component piston is provided in which the hollow annular space in the piston head for the cooling oil is closed off underneath. This is achieved with a sheet-metal ring with a collet which fits in a recess in the piston-ring wall, the sheet metal ring being biased via a retaining clip against the shaft bush.

5 Claims, 1 Drawing Sheet

COOLED MULTI-COMPONENT PISTON FOR INTERNAL COMBUSTION ENGINES

BACKGROUND OF THE INVENTION

1. Field of the Invention

The present invention relates to a cooled multi-component piston for internal combustion engines.

2. The Prior Art

This type of piston is known, for example, from DD 2 638 A. In this known piston, the annular wall parts for covering an annular cooling duct are slotted rings which are installed under stress on the inside or outside thereof. An axial stressing of the ring is present to some extent as well. To the extent to which the rings are axially stressed either on the inside or outside, the edge of the ring that is in each case radially removed from the clamping point is axially unsupported.

SUMMARY OF THE INVENTION

It is an object of the present invention to create an annular cover wall which, at the same time, is radially safely locked on the inside and outside against axial displacement. Furthermore, the cover wall is secured in a simple, destruction-free and operationally safe manner.

The above object is achieved according to the present invention by providing that the annular wall part, which is divided on its circumference into at least two separated annular segments, has radially both on the inside and outside a collet extending all around. With this collet, it engages radially on the inside and outside with radial clamping, in mating, form-locking recesses on the inner circumference on the outer annular rib of the piston and in the boss support disposed within the piston, respectively. In this regard, radial clamping is achieved through an elastic deformation of the collets in the direction perpendicular to the longitudinal axis of the piston.

According to the solution of the prior art problem by the piston of the invention, such elastic deformation of the collets in the installed condition constitutes a very important feature. Due to its accommodation on the inside and outside, the wall part can be safely secured in a simple way in an elastic snap lock on the head part of the piston. Furthermore, the double clamping permits thin wall thicknesses for the wall part, because the latter has no freely swinging zones, as is the case with the annular connection part according to the above-mentioned prior art document.

For accomplishing the radial clamping, it is important that provision is made on the collet for radial slots radially on the inside and outside, so that radially elastic lashings are obtained distributed across the circumference of the annular wall part. The required elastic clamping of the wall part would not be possible with unslotted, through-extending collets. This constitutes another difference vis-a-vis the design of an annular cooling duct cover known from the above-mentioned prior art reference.

Furthermore, special importance has to be attributed to the feature that the annular wall part is divided on its circumference at least once, i.e., that at least two annular segments are present. Only such division permits using the annular wall part with piston head parts having bosses whose outside diameters project significantly beyond the inside diameter of the radial inner sealing of the cooling duct, because in such cases, annular covers of the type according to DD 252 638 A cannot be installed. Such known annular sealings are radially slotted only once, so that a ring is obtained that is spread open. Such a ring, however, is radially expandable only to a minor extent if it is to retain its clamping effect and if its material is not to be damaged during spreading. Such minor measure does in many cases not suffice to assist in mounting such a ring. With the design according to the aforementioned prior art reference, this constitutes a very decisive difference. This difference is serious particularly because a cover ring according to the prior art reference which, for example, is divided into two separate halves, could not be secured at all in any functionally safe manner according to the disclosure of said reference.

The differences and advantages specified above vis-a-vis DD 252 638 A are valid vis-a-vis U.S. Pat. No. 4,377,967 as well. Moreover, apart from the feature according to which the wall part is radially divided circumferentially into at least two annular segments, the above-specified features of distinction are valid also vis-a-vis DE 36 43 039 A (which corresponds to U.S. Pat. No. 5,052,280).

BRIEF DESCRIPTION OF THE DRAWINGS

Other objects and features of the present invention will become apparent from the following detailed description considered in connection with the accompanying drawings which discloses an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
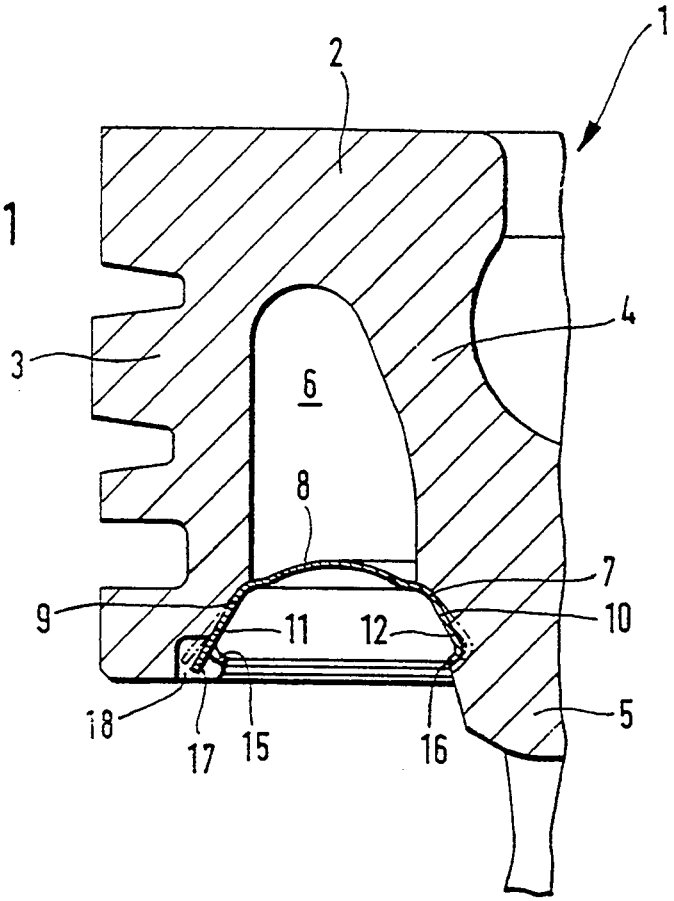
FIG. 1 shows a longitudinal section through a cutout of the head part of a two-part joint piston.
Figure 2:
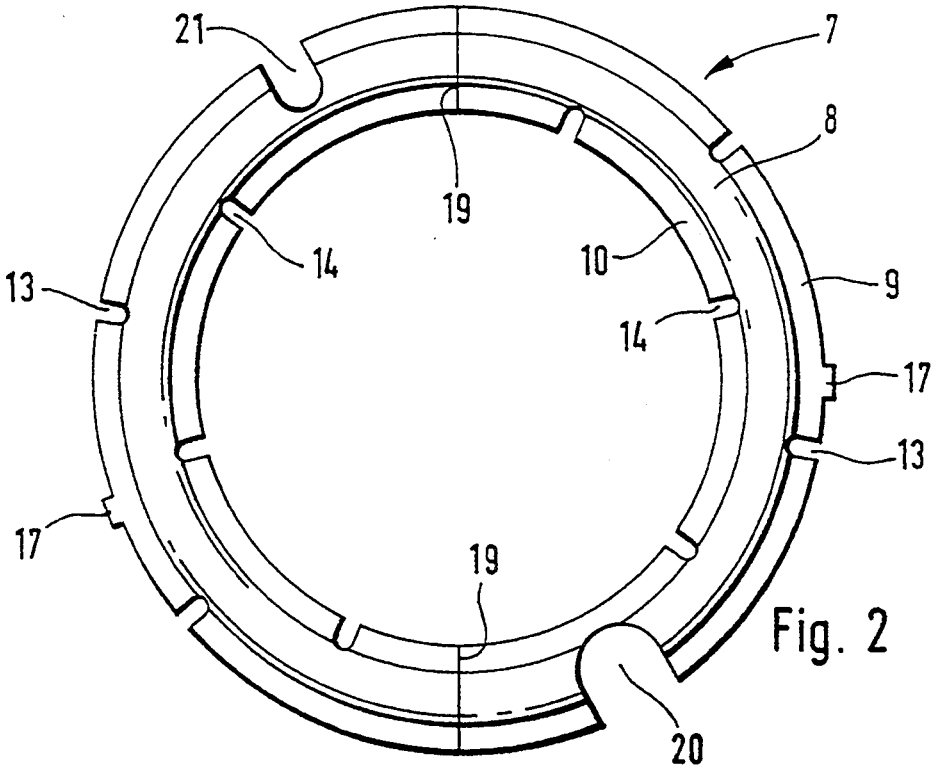
FIG. 2 shows a top view of a sheet metal ring clamped in the head part according to FIG. 1.

With a joint piston, a head part 1 and a shaft are connected articulated via piston pin. The shaft and the piston pin are not shown in the exemplified embodiment shown in the drawing.

Turning now in detail to the drawings, FIG. 1 shows a piston head 1 with an outer annular wall 3 containing the grooves for the piston rings extending from the piston bottom 2. An annular rib 4 connects bosses 5 with the bottom 2 radially with a spacing within the annular wall 3. An annular hollow space 6 exists between the annular rib 4 and the annular wall 3. The hollow space 6 is covered by a wall part in the form of a sheet metal ring 7, to form a closed cooling oil space.

The sheet metal ring 7 has an upwardly curved annular surface 8 with the collets 9 and 10 shaped thereon on the outer and inner circumferences, respectively. The collets 9 and 10, which point downwardly from the upwardly curved annular surface 8, assume in their resting position the contour shown by broken lines in FIG. 1. The collets 9 and 10, which point downwardly from the upwardly curved annular surface 8, assume in their resting position the contour shown by broken lines in FIG. 1. After its installation, the sheet metal ring 7 rests under prestress with its outer collet 9 in a matching recess 11 on the inner circumference of the annular wall 3, on the one hand, and with its inner collet 10 in a matching recess 12 on the outer circumference of the annular rib 4, or boss 5, on the other hand. In order to permit the collets 9 and 10 to be elastically deformed, they are provided with longitudinal slots 13 and 14, respectively, distributed on the outer and inner circumferences. These slots extend across the full length of the collets 9 and 10.

In order to improve the seating of the sheet metal ring 7 in the recesses 11 and 12, the collets 9 and 10 are bent inwardly toward each other at their open ends 15 and 16. As a safety element mechanism to prevent turning, a nose 17 projecting from the collet 9 is formed on the sheet metal ring 7, and said nose projects into a matching recess 18 provided in the annular wall 3.

The sheet metal ring can be made in two parts with separation joints being present, and have the recesses 20 and 21 for the feeding and the discharging of cooling oil.

For obtaining the required prestress, the sheet metal ring 7 should be made of an elastic material, for example, spring steel.

With such a design, a tight closure of the annular hollow space 6 required for the cooling oil flowing therethrough is obtained for a joint piston in a constructively simple way.

While only one embodiment of the present invention has been shown and described, it is to be understood that many changes and modifications may be made thereunto without departing from the spirit and scope of the invention as defined in the appended claims.

We claim:

1. Cooled multi-component piston for use with an internal combustion engine, comprising a head part with bosses formed thereon for receiving a piston pin connecting the piston with a piston rod;

an outer annular wall changing at a first end into the bottom of the head part and ending open at its second end for receiving at least one piston ring groove, and with a hollow space joined up radially on the inside with said annular wall and open to the second end of the annular wall, and surrounding the bosses or their supporting parts extending to the bottom of the head part, which supporting parts comprise an annular rib, said hollow space being closed approximately at the level of the second end of the annular wall by an annular wall part so as to form a through-flow cooling oil space, whereby the wall part is clamped under prestress between supports on the bosses or supporting parts of the head part, and radially on the outside on the annular wall, where it rests freely in each case, and with a piston shaft connected with the head part only via the piston pin;

the wall part being an annular surface divided circumferentially at least once and having an outer collet formed on the outer circumference and having an inner collet formed on the inner circumference, said collets extending all around and being slotted radially on the inside and outside by cuts; and said wall part engaging with the outer collet formed on the outer circumference in a recess on the inner circumference of the annular wall, and with the inner collet formed on the inner circumference in a recess of the annular rib.

2. Multi-component piston according to claim 1, further comprising the wall part having as a safety element against turning at least one nose projecting into a recess provided on the annular wall and from the outer collet.

3. Multi-component piston according to claim 1, wherein the ends of the two collets are bent inwardly toward each other.

4. Multi-component piston according to claim 1, wherein the wall part comprises a sheet metal ring.

5. Multi-component piston according to claim 1, wherein the wall part comprises two parts.

* * * * *